US006089025A

United States Patent [19]

Tekriwal et al.

[11] Patent Number: 6,089,025

[45] Date of Patent: Jul. 18, 2000

[54] COMBUSTOR BAFFLE

[75] Inventors: Prabhat Kumar Tekriwal, Schenectady; Lewis Berkley Davis, Jr., Niskayuna; Warren James Mick, Schenectady, all of N.Y.

[73] Assignee: General Electric Company, Schenectady, N.Y.

[21] Appl. No.: 09/138,728

[22] Filed: Aug. 24, 1998

[51] Int. Cl.[7] ..... F02C 1/00

[52] U.S. Cl. ..... 60/737; 60/746; 60/749

[58] Field of Search ..... 60/39.11, 737, 60/738, 746, 748

[56] References Cited

U.S. PATENT DOCUMENTS 4,365,477 12/1982 Pearce ..... 60/737
4,698,963 10/1987 Taylor ..... 60/39.06
5,099,644 3/1992 Sabla et al. ..... 60/267

*Primary Examiner*—Timothy S Thorpe
*Assistant Examiner*—Ehud Gartenberg
*Attorney, Agent, or Firm*—Patrick K. Patnode; Marvin Snyder

[57] ABSTRACT

A combustor assembly comprises a plurality of circumferentially arranged fuel nozzles, which fuel nozzles have a first end coupled to a combustion chamber and a second end attached to an endcover. The plurality of fuel nozzles define a central region therebetween. A baffle is disposed within the central region. The baffle has an upstream base portion adjacent the endcover and a contoured downstream portion having a width that is smaller with respect to a width of the upstream base portion so as to transition a recirculating flow into a downstream flow to minimize flashback occurrences within the central region.

12 Claims, 7 Drawing Sheets

(3 of 7 Drawing Sheet(s) Filed in Color)

COMBUSTOR BAFFLE

BACKGROUND OF THE INVENTION

This invention relates generally to power generation combustors and more specifically to combustor baffles.

Industrial power generation gas turbine engines include a compressor for compressing air that is mixed with fuel and ignited in a combustor for generating combustion gases. The combustion gases flow to a turbine that extracts energy for driving a shaft to power the compressor and produces output power for powering an electrical generator, for example. The turbine is typically operated for extended periods of time at a relatively high base load for powering the generator to produce electrical power to a utility grid, for example. Exhaust emissions from the combustion gases are therefore a concern and are subjected to mandated limits.

Gas turbine combustors are being developed that employ lean premixed combustion to reduce emissions of gases such as NOx (nitrogen oxides). One such combustor comprises a plurality of burners attached to a single combustion chamber. Each burner includes a flow tube with a centrally disposed fuel nozzle comprising a center hub which supports fuel injectors and swirl vanes. During operation, fuel is injected through the fuel injectors and is mixed with the swirling air in the flow tube, and a flame is produced at the exit of the burner. The combustion flame is stabilized by a combination of bluffbody recirculation behind the center hub and swirl-induced recirculation. Because of the lean stoichiometry, lean premixed combustion achieves lower flame temperature and thus produces lower NOx emissions.

These premixed systems, however, are susceptible to an unpredictable phenomena commonly referred to as "flashback." Flashback is caused by any of a number of events including ignition of impurities in fuel or ignition during mode switching when the flames are in a transient phase. When flashback occurs, a flame enters zones or cavities of the combustor chamber that are not designed to contain flames. One such zone where a flashback is of concern is the region between the fuel nozzles up against the endcover. The recirculating air flow pattern in this region and the possible presence of fuel makes it susceptible to flashback. A flashback in this area can result in a loss of combustion control and can additionally cause heating and melting of combustor parts like fuel nozzles, for example, that are not designed to withstand excessive heating.

Furthermore, the ever increasing demand for turbines with improved thermodynamic efficiency has resulted in higher turbine inlet temperatures. The higher turbine inlet temperatures create a corresponding increase in compressor discharge temperatures and pressure ratio. The combination of these conditions make the autoignition of fuel more likely.

Accordingly, there is a need in the art for improved recirculation within the endcover region to reduce the occurrence of flashback.

SUMMARY OF THE INVENTION

A combustor assembly comprises a plurality of circumferentially arranged fuel nozzles, which fuel nozzles have a first end coupled to a combustion chamber and a second end attached to an endcover. The plurality of fuel nozzles define a central region therebetween. A baffle is disposed within the central region. The baffle has an upstream base portion adjacent the endcover and a contoured downstream portion having a width that is smaller with respect to a width of the upstream base portion so as to transition a recirculating flow into a downstream flow to minimize flashback occurrences within the central region.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DETAILED DESCRIPTION OF THE INVENTION

Figure 1:
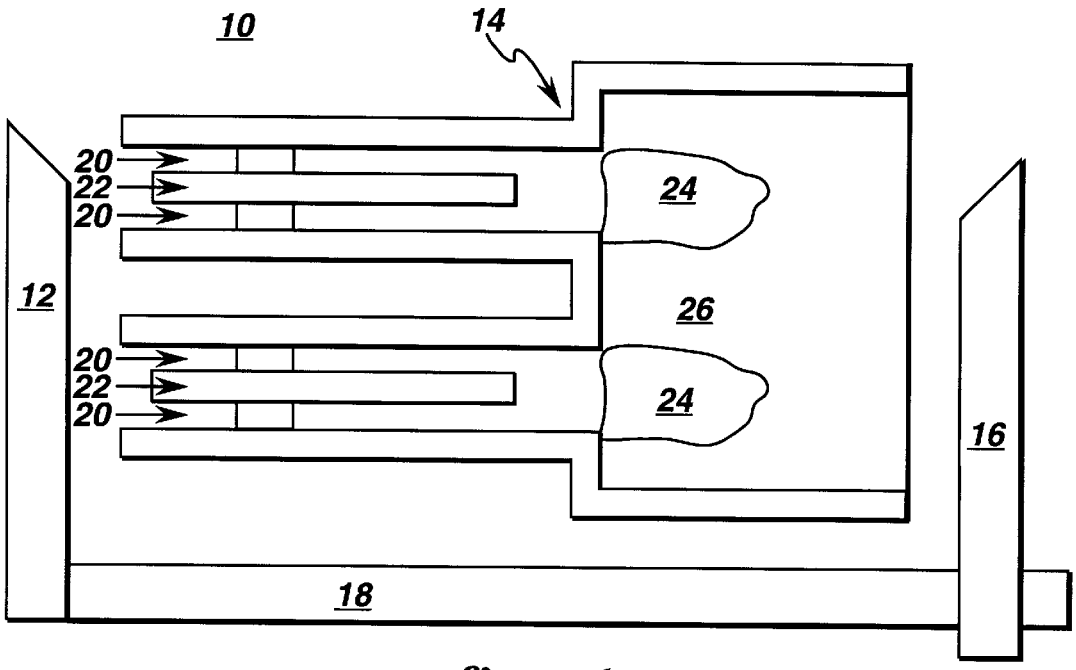
fig. 1 PRIOR ART
FIG. 1 is a schematic illustration of a conventional industrial turbine engine.

An industrial turbine engine 10 includes a compressor 12 disposed in serial flow communication with a combustor assembly 14 and a single or multi-stage turbine 16, as shown in FIG. 1. Turbine 16 is coupled to compressor 12 by a drive shaft 18, a portion of which drive shaft 18 extends for powering an electrical generator (not shown) for generating electrical power. During operation, compressor 12 discharges compressed air 20 into combustor assembly 14 wherein compressed air 20 is mixed with fuel 22 and ignited for generating combustion gases 24 in a combustion chamber 26 from which energy is extracted by turbine 16 for rotating shaft 18 to power compressor 12, as well as producing output power for driving the generator or other external load.

Figure 2:
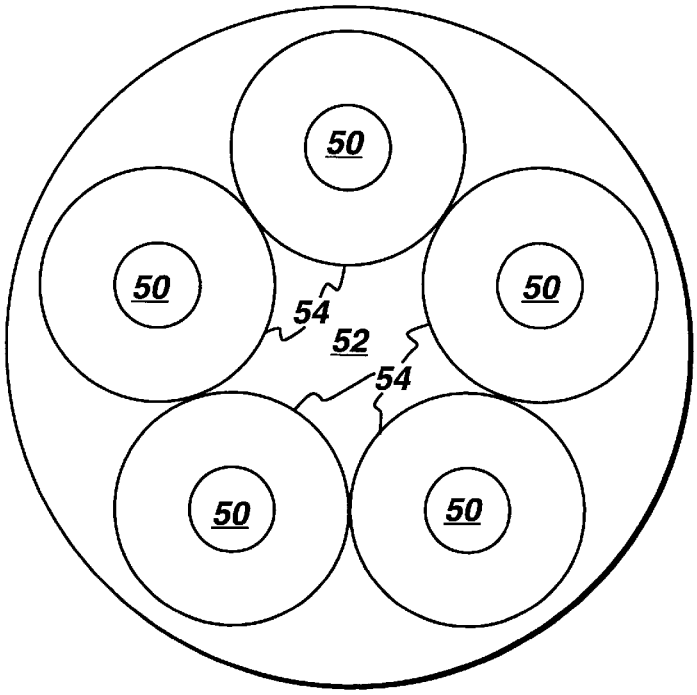
fig. 2 PRIOR ART
FIG. 2 is a schematic plan view of one end of an exemplary combustor nozzle arrangement.

Each combustor assembly 14 has a plurality, for example five, concentrically and circumferentially disposed upstream nozzles 50, as shown in the schematic plan view of FIG. 2. Each nozzle 50 is coupled to a pair of circumferentially disposed adjacent nozzles 50 so as to form a concentric nozzle arrangement of circumferentially adjoining nozzles 50. The concentric arrangement of nozzles 50 defines a central region 52 therebetween. An outer portion 54 of each nozzle 50 defines an outer extremis of central region 52. In one embodiment, outer portion 54 of each nozzle 50 is arcuate thereby defining a star-shaped outer extremis geometry for central region 52.

Figure 3:
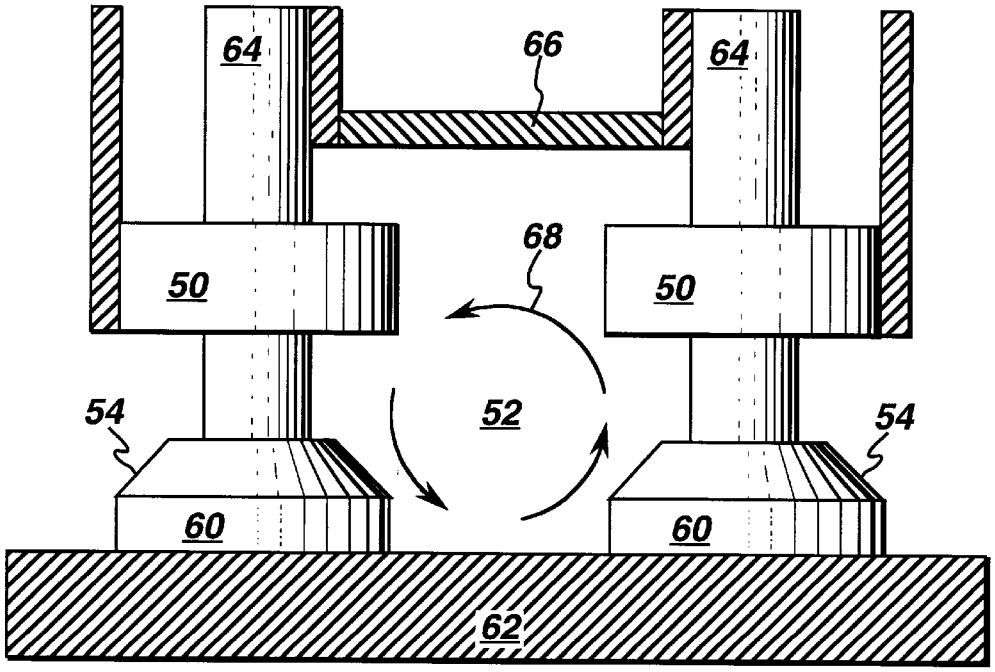
fig. 3 PRIOR ART
FIG. 3 is a schematic side elevation view with parts removed of an exemplary combustor nozzle arrangement.

Each nozzle 50 comprises a first end 60 coupled to an end cover 62 and a second end 64 coupled to combustor assembly 14 (FIG. 1) to supply premixed fuel 22 and air 20 into combustion chamber 26 for combustion therein, as shown in FIG. 3. An end-plate 66 is typically disposed adjacent second end 64 of nozzle 50 interconnecting each circumferentially adjoining nozzle 50 and preventing unwanted back-flow of any fuel air mixture exiting second end 64, within central region 52. Accordingly, central region 52 is typically a chamber defined by end-cover 62, adjoining outer portions 54 of nozzles 50 and end plate 66.

As discussed above, recirculation air 68 is typically found within central region 52. The presence of fuel within central region 52 combined with recirculation air 68 provides an optimal region for flashback to occur.

Figure 4:
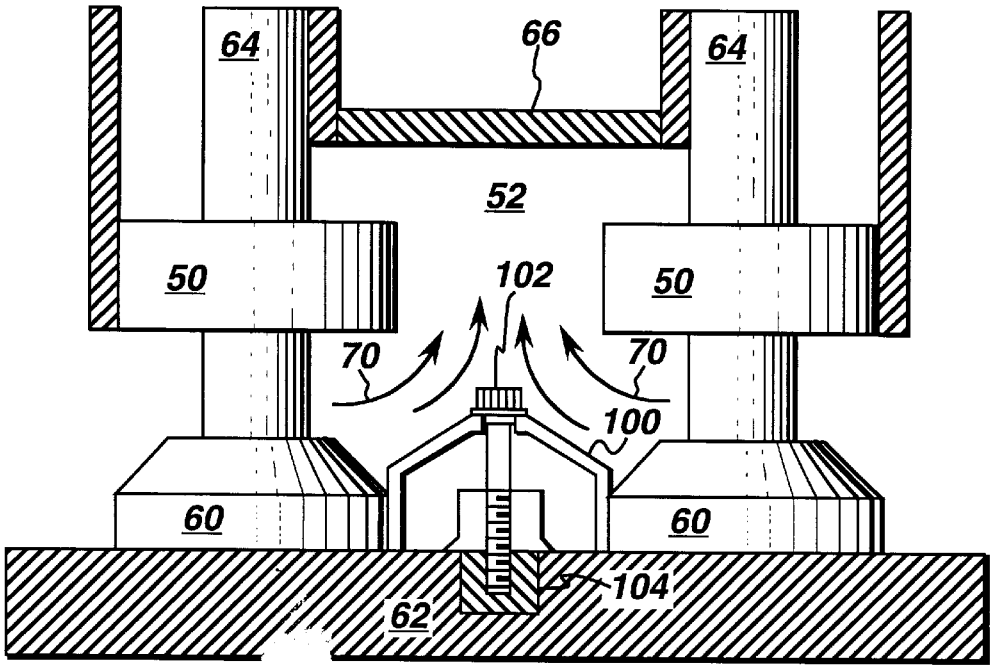
FIG. 4 is a schematic side elevation view with parts removed of a combustor nozzle arrangement in accordance with one embodiment of the instant invention.

In accordance with one embodiment of the instant invention, a baffle 100 is disposed within central region 58 to minimize air recirculation therein, as shown in FIG. 4. In one embodiment, baffle 100 is affixed to endcover 62 with a fastener 102, threadingly engaged with a bore 104 disposed within endcover 62. In one embodiment, fastener 102 is a ⅝"×2.5" reduced shank UNC bolt. In an alternative embodiment, baffle 100 is integral with end cover 62 and machined to appropriate dimensions during a manufacturing process.

Figure 5:
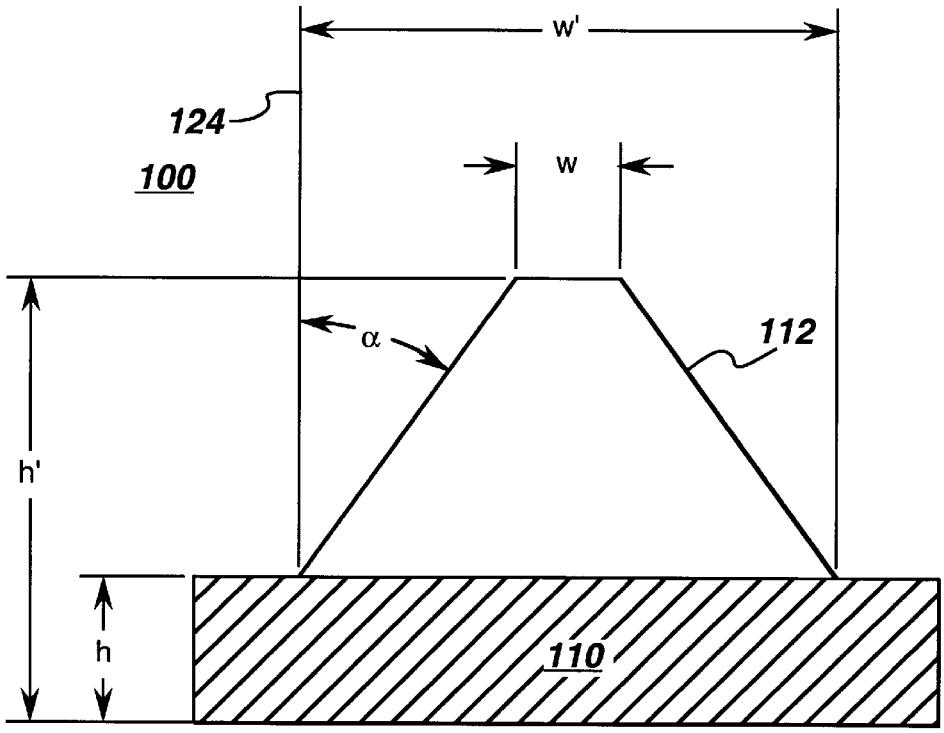
FIG. 5 is a schematic, cross-sectional, side elevation view of a combustor baffle in accordance with one embodiment of the instant invention.

Baffle 100 consists of an upstream base portion 110 adjacent endcover 62 and a contoured downstream portion 112 having a width that is smaller with respect to a width of upstream base portion 110, as best shown in FIG. 5. In one embodiment, baffle 100 is made of Hastelloy X.

Baffle 100 transitions recirculating air flow 68 (FIG. 3) into non-recirculating flow 70 (FIG. 4). Accordingly, because non-recirculating flow 70 moves fuel and air downstream toward combustion chamber 26 (FIG. 1) flashback occurrences within central region 52 (FIG. 4) are minimized and even eliminated.

Upstream base portion 110 is configured to be matedly disposed between respective outer portions of nozzles 50 (FIG. 4). In one embodiment, the height (h) of base portion 110 is in the range between about 0.25 inches and about 1.125 inches (FIG. 5). In one embodiment, baffle 100 has a height (h') in the range between about 1.5 in. and about 2.5 in.

In one embodiment, contoured downstream portion 112 narrows from a width (w) in the range between about 3.0 inches and about 4.0 inches at an upstream portion to a width (w') in the range between about 0.75 inches and about 1.30 inches at a downstream portion to create a conical shaped contour.

In one embodiment of the instant invention, contoured upstream portion 112 narrows from wider downstream base portion 110 at an angle ($\alpha$) in the range between about 35° to about 55°, typically 45°, with respect to a reference line 124. Reference line 124 is typically inclined perpendicular to end cover 62.

Figure 6:
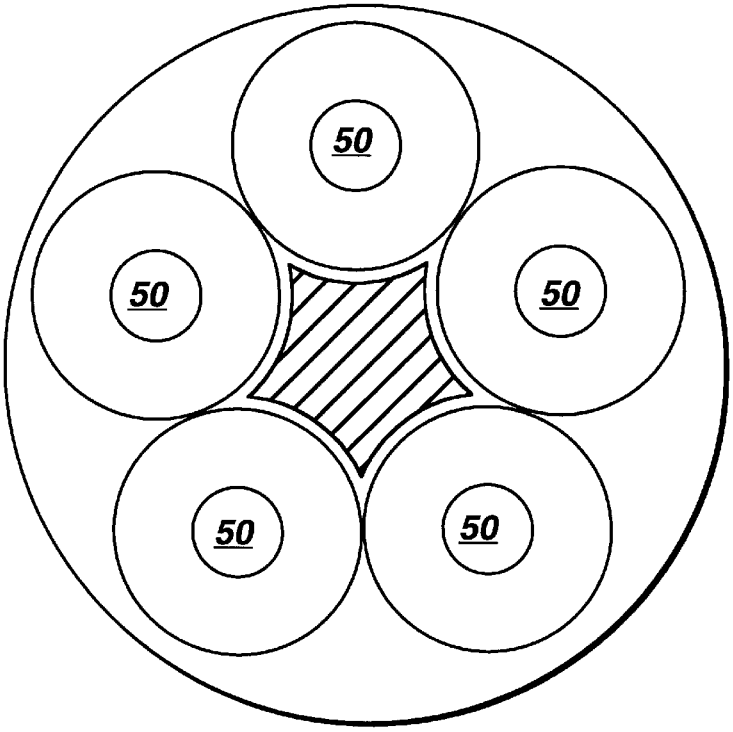
FIG. 6 is a schematic plan view of one end of the combustor nozzle arrangement of FIG. 4.

In one embodiment, five nozzles define a central region 52 having a geometric shape of a five-pointed star. Accordingly, in this embodiment, baffle 100 has a generally star-shaped geometry so as to uniformly mate with each of the five nozzles as best shown in FIG. 6.

Figure 7:
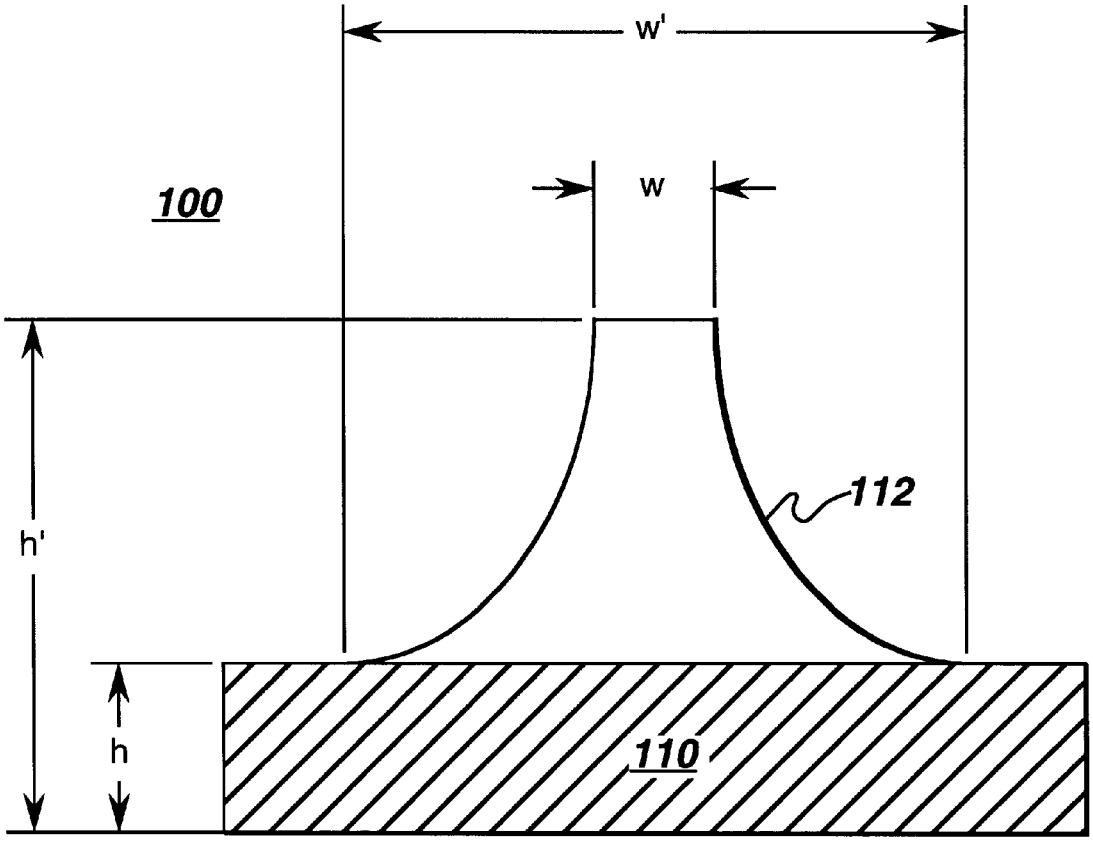
FIG. 7 is a schematic, cross-sectional, side elevation view of a combustor baffle in accordance with another embodiment of the instant invention.

In another embodiment 200, as shown in FIG. 7, contoured upstream portion 112 narrows from a wider base portion to a narrower downstream portion so as to create a quasi-conical contour. The outer surface is contoured as an arc defined by an axial length (h'–h in FIG. 7) in the range between about 1.25 inches and about 1.375 inches and a radius of curvature of about 2.2 inches. This baffle design is more aerodynamic in shape and conforms to the fluid flow better by providing less blockage (or resistance) to the flow. This baffle design, therefore, is expected to yield lower pressure drop requirements. The lower pressure drop offers the advantage of lower pumping cost.

Figure 8:
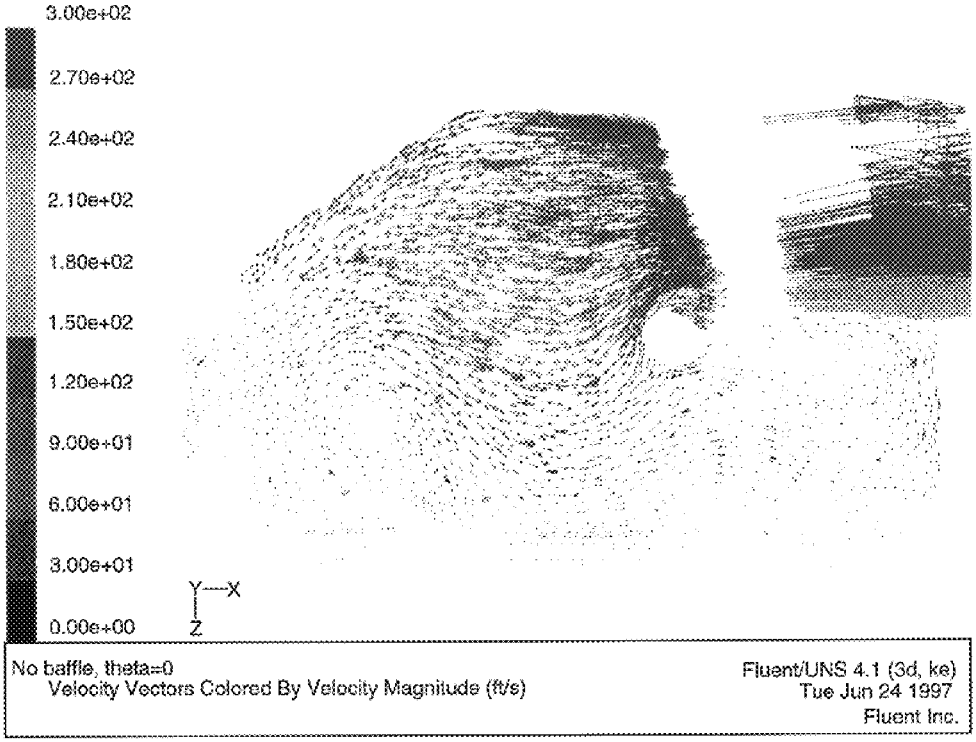
FIG. 8 is an exemplary pattern of velocity vectors colored by velocity magnitude within a central region without a baffle.

FIG. 8 depicts an exemplary pattern of velocity vectors colored by velocity magnitude within central region without baffle. A large recirculation zone in central region near endcover plate is seen.

This recirculation zone is a potential sight of flashback and flame holding. Relatively weaker recirculation zones also exist axially downstream of nozzle in a dead region. The relatively stronger recirculation zone near endcover provides a site for flashback in the presence of fuel and should be eliminated to avoid the flame-holding in the central region. Presence of fuel in central region could be either intentional by design to achieve better combustion and flame stability or unintentional due to fuel leak.

Figure 9:
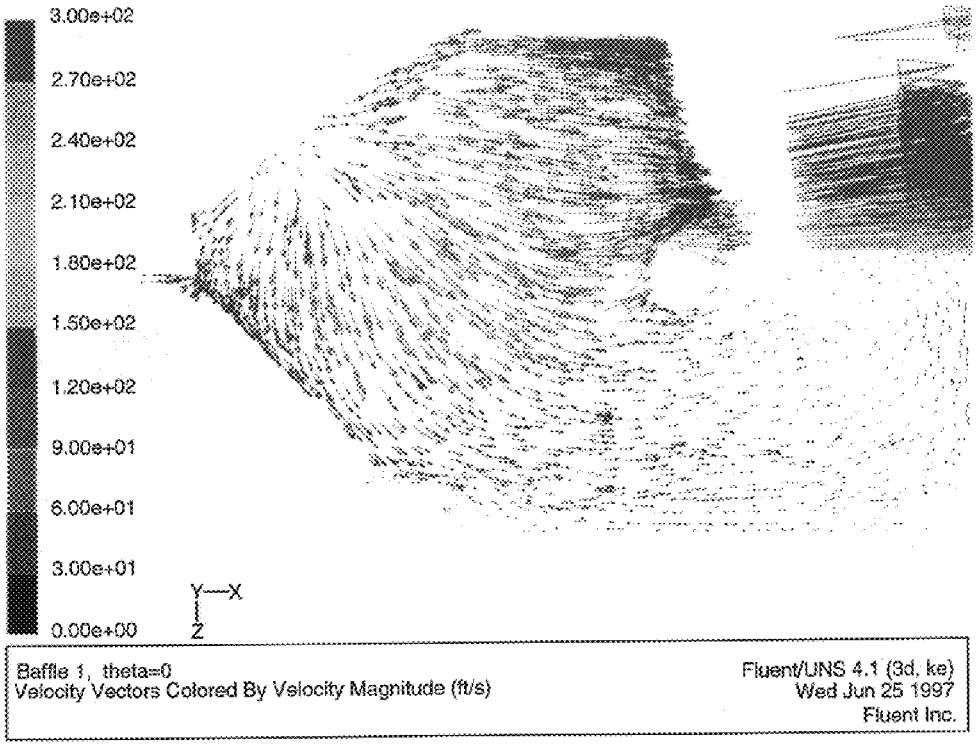
FIG. 9 is an exemplary pattern of velocity vectors colored by velocity magnitude within a central region with a baffle in accordance with the one embodiment of instant invention.

FIG. 9 depicts an exemplary pattern of velocity vectors colored by velocity magnitude within a central region with baffle 100. The strong recirculation zone in central region near endcover (as seen in FIG. 8) is eliminated in FIG. 9. Accordingly, baffle 100 eliminates a potential sight for flame holding should flashback occur in central region. This configuration, however, does show the presence of a "weak" recirculation downstream in the dead region.

Figure 10:
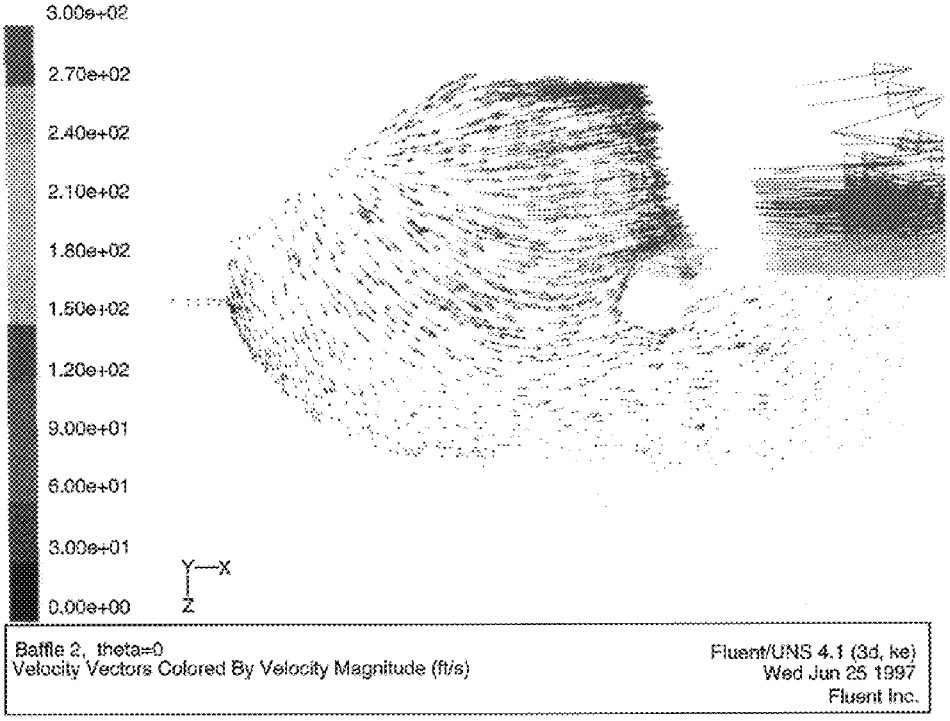
FIG. 10 is an exemplary pattern of velocity vectors colored by velocity magnitude within a central region with another baffle in accordance with one other embodiment of the instant invention.

FIG. 10 depicts an exemplary pattern of velocity vectors colored by velocity magnitude within a central region with another baffle design 200. The strong recirculation zone in central region near endcover (as seen in FIG. 8) is eliminated also in FIG. 10. Thus this design also eliminates the potential sight for flame holding should the flashback occur in central region. In addition, this baffle design also eliminates the "weak" downstream recirculation.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A combustor assembly comprising:

a plurality of circumferentially arranged fuel premixed with air nozzles, which nozzles have a first end coupled to a combustion chamber end cover and a second end attached to an endplate, said plurality of nozzles defining a central region therebetween; and a baffle disposed within said central region, which baffle has an upstream base portion attached to said endcover and a contoured downstream portion having a width that is smaller with respect to a width of said upstream base portion so as to modify a recirculating flow into a downstream flow to minimize flashback occurrences within said central region.

2. A combustor assembly in accordance with claim 1, wherein the number of said plurality of fuel nozzles is five.

3. A combustor assembly in accordance with claim 1, wherein said baffle is coupled to said endcover with a fastener threadingly engaged with a bore disposed within said endcover.

4. A combustor assembly in accordance with claim 1, wherein said baffle is made of Hastelloy X.

5. A combustor assembly in accordance with claim 1, wherein said base portion of said baffle is configured so as to be matedly disposed with respective outer surfaces of said plurality of nozzles.

6. A combustor assembly in accordance with claim 1, wherein said base portion of said baffle has a height in the range between 0.25 inches and about 1.125 inches.

7. A combustor assembly in accordance with claim 1, wherein said contoured downstream portion is contoured as an arc defined by an axial length in the range between about 1.25 inches and about 1.375 inches and a radius of curvature of about 2.2 inches.

8. A combustor assembly in accordance with claim 2, wherein said base portion is configured in a generally star-shaped configuration so as to be matedly disposed with respective outer surfaces of said five fuel nozzles.

9. A combustor assembly in accordance with claim 1, wherein said contoured downstream portion is conically-shaped.

10. A combustor assembly in accordance with claim 1, wherein said baffle has a height in the range between about 1.5 inches and about 2.5 inches.

11. An industrial turbine engine having a combustor assembly comprising:

a plurality of circumferentially arranged fuel premixed with air nozzles, which nozzles have a first end coupled to a combustion chamber end cover and a second end attached to an endplate, said plurality of nozzles defining a central region therebetween; and a baffle disposed within said central region, which baffle has an upstream base portion attached to said endcover and a contoured downstream portion having a width that is smaller with respect to a width of said upstream base portion so as to modify a reciculating flow into a downstream flow to minimize flashback occurrences within said central region.

12. An industrial turbine engine in accordance with claim 11, wherein said base portion of said baffle is configured so as to be matedly disposed with respective outer surfaces of said plurality of nozzles.

* * * * *